US005141152A

United States Patent [19]

Spanko

[11] Patent Number: 5,141,152

[45] Date of Patent: Aug. 25, 1992

[54] FLUE GAS CLOSURE SYSTEM

[75] Inventor: John M. Spanko, Norwalk, Ohio

[73] Assignee: York International, York, Pa.

[21] Appl. No.: 631,416

[22] Filed: Dec. 21, 1990

[51] Int. Cl.[5] ..... F23N 3/00; G05D 23/00

[52] U.S. Cl. ..... 236/16; 126/116 A; 126/285 A; 126/285 B; 431/20

[58] Field of Search ..... 126/285 B, 285 A, 116 R, 126/116 A; 236/1 G; 110/163; 431/20; 165/39

[56] References Cited

U.S. PATENT DOCUMENTS

| | | | |
|---|---|---|---|
| 4,266,929 | 5/1981 | Swenson | 236/1 G X |
| 4,270,894 | 6/1982 | Moore, Jr. et al. | 236/1 G X |
| 4,404,613 | 9/1983 | Channing et al. | 110/163 X |
| 4,421,096 | 12/1983 | Butzen | 126/285 B |
| 4,439,139 | 3/1984 | Nelson et al. | 236/1 G X |

FOREIGN PATENT DOCUMENTS

| | | | |
|---|---|---|---|
| 8267 | of 1908 | United Kingdom | 236/1 G |

*Primary Examiner*—Edward G. Favors
*Attorney, Agent, or Firm*—Finnegan, Henderson, Farabow, Garrett & Dunner

[57] ABSTRACT

A flue gas closure system for a furnace which includes a burner and a heat exchanger through which flue gas flows. The system includes a closure member which in an open position permits the flow of flue gas through the heat exchanger and in a closed position prevents the flow of air through the heat exchanger and means for causing said closure member to be in an open position when the burners are on and to be in a closed position when the burners are off. The closure member includes a closure plate which is slidably connected to the heat exchanger. An actuator is connected to said closure member for moving said closure member to at least one of the open and closed positions.

17 Claims, 2 Drawing Sheets

FLUE GAS CLOSURE SYSTEM

BACKGROUND OF THE INVENTION

A. Field of the Invention

This invention relates generally to heat furnaces and specifically to a device for preventing the escape of heated air from the heat exchanger when the burner is not operating but allowing the flow of flue gases through the heat exchangers during burner operation.

B. Description of the Prior Art

The invention is applicable to standard furnaces, including atmospherically vented gas fired furnaces. Such a furnace typically includes one or more burners, a heat exchanger, a blower, and a venting system. The blower circulates air through the furnace. When the burner is operating, combustion products flow upward into and through the heat exchanger, transferring heat to the heat exchanger. The heat exchanger in turn transfers heat to conditioned air being circulated through the furnace. The combustion products in the heat exchanger exit the heat exchanger through the heat exchanger outlets and usually are mixed in the drafthood with ambient air admitted through the permanently open drafthood relief opening. The combustion products/air mixture then exits the furnace through an opening in the top of the drafthood and enters a vent connector which is part of the venting system. The venting system then exhausts the combustion products into the atmosphere.

The above described furnaces have inherent inefficiencies when the burner is not operating. At the completion of the burner cycle, the heat exchanger is still warm. However, air continues to flow through the flue gas passages of the heat exchanger and absorbs heat, thereby cooling the heat exchanger. The warmed air then flows into the venting system where it is exhausted outdoors. As a result, heat is wasted, thereby decreasing the efficiency of the heat furnace.

One attempted solution to this problem consisted of a vent damper installed in the vent connector. Such a vent damper closed the vent connector while the burner was not operating so that the stored heat was transferred to air exited through the drafthood relief opening instead of through the venting system. In such a system, the transferred heat would exit directly from the furnace and would be wasted if the furnace was installed in an unconditioned space. Thus, the heat would still be wasted unless the furnace itself was installed in a conditioned space. In addition, the installation of the vent damper also required extra time and expense, as well as other problems associated with installation, such as possible improper wiring or the selection of the wrong device. As a result, the vent damper approach provided a partial solution, at best.

SUMMARY OF INVENTION

The present invention overcomes the problems and disadvantages of the prior art by providing a system which blocks the flow of air through a heat exchanger of a furnace, when the furnace burners are turned off, and which permits the flow of flue gas through the heat exchanger, when the burners are turned on. As a result, the heat held by the heat exchanger at the conclusion of an on cycle is not lost to the exhaust air or an unconditioned space. The system preferably is an integral part of the furnace and therefore can be installed at the factory. Any on-site installation and the inherent problems associated with on-site installation are eliminated.

It is, therefore, an object of the present invention to design a system to prevent the flow of air through the heat exchanger of a furnace while the burner is not operating.

Another object is to increase the efficiency of the furnace, regardless of whether the furnace is installed in a conditioned or an unconditioned space.

Still another object is to design a flue closure control system that can be an integral part of the furnace, thereby eliminating the problems associated with on-site installation.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a flue closure system for a heat furnace which includes a burner and a heat exchanger for accepting flue gas, the system comprising a closure member which in an open position permits the flow of flue gas through the heat exchanger and in a closed position prevents the flow of air through the heat exchanger; and means for causing said closure member to be in the open position when the burners are on and to be in the closed position when the burners are off.

In the disclosed preferred embodiment, the flue closure system includes a plate capable of closing off the heat exchanger outlets so that no air can flow through the flue gas passages, an actuator which moves the plate over the heat exchanger outlets immediately after the burner-on cycle and moves the plate away from the outlets immediately prior to the burner-on cycle, a safety switch which controls the burner operation, and control circuitry connected with the activator and the safety switch to ensure that the plate is not covering the heat exchanger outlets during burner operation. The plate and actuator in the preferred embodiment are attached to the heat exchanger wall, but these elements could readily be fixed to other portions of the furnace. All of the main mechanical components of the preferred embodiment of the flue closure system of the present invention are contained within the housing of the furnace and are an integral part of the furnace.

The flue closure device operates in the following manner. When the burner is operating, the plate is in an open position which allows flue gases to flow through the flue gas passages of the heat exchanger. After the burner-on cycle is over, the actuator moves the plate to a closed position that prevents air from flowing through the heat exchanger. This in turn ensures that no heat is lost to air flowing through the flue gas passages of the heat exchanger. When the burner-off cycle is over, the actuator then moves the plate to the open position until the next burner-off cycle. The switch and control circuitry ensures that the plate is in its correct position by preventing burner operation until the actuator has moved the plate away from the heat exchanger outlets.

The flue closure system enhances the efficiency of the furnace and also eliminates the problems associated with on-site installation since the device is an integral part of the furnace and is installed at the factory, thus requiring no additional time and expense at the furnace installation site.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

Figure 2:
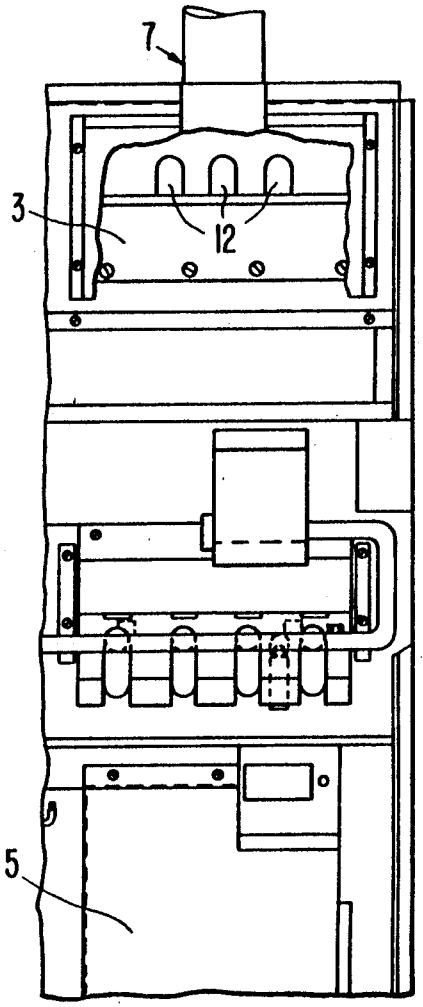
FIG. 2 is a front partial cross-sectional view of the prior art furnace illustrated in FIG. 1.
Figure 1:
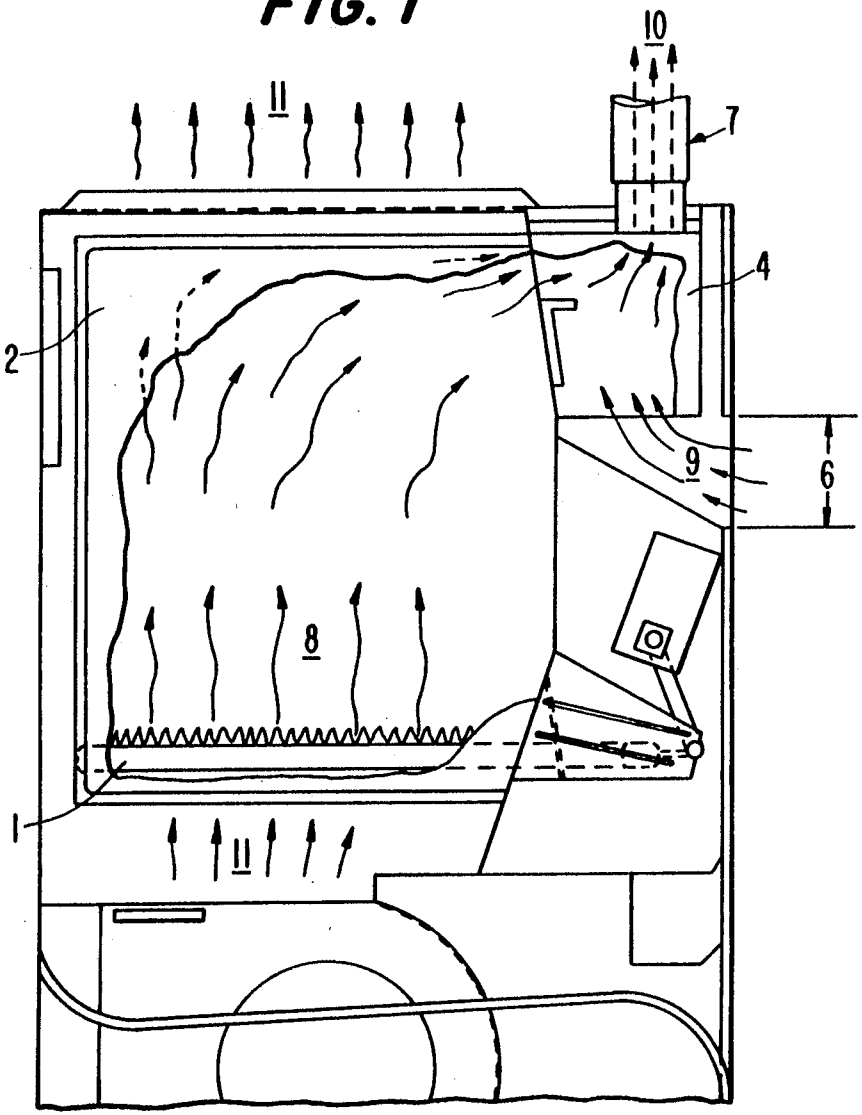
FIG. 1 is a side partial cross-sectional view of a prior art furnace.

Referring to FIGS. 1 and 2, an atmospherically vented gas-fired furnace is shown. In the illustration, the main burner(s) 1 is operating. Combustion products flow upward through the heat exchanger 2, transferring heat to the heat exchanger which in turn transfers heat tot he air 11 circulated through the furnace by the blower 5. Flue restrictor plate 3 is fixed and is incorporated in the furnace design to regulate the flow of combustion products to maximize heat transfer, hence efficiency, when the main burner(s) is operating. Combustion products exit the heat exchanger through the heat exchanger outlet(s) 12 and enter the drafthood 4, where they mix with ambient air 9 admitted through the permanently open relief opening 6. Diluted combustion products 10 exit the furnace through the opening in the top of the drafthood and enter the vent connector 7 which is part of the building's venting system, through which the diluted combustion products are ultimately exhausted to the outdoors.

At the completion of the burner-on cycle, the heat exchanger 2 is still warm. Air continues to flow through the flue gas passages of the heat exchanger and absorbs heat. This warmed air then flows into the building's venting system where it is exhausted outdoors and is wasted. When a vent damper (not shown) is installed in the vent connector 7, it acts to close off the vent connector at the completion of the burner-on cycle so that heat cannot escape up the venting system, but instead escapes through the permanently open drafthood relief opening 6. When the furnace is not installed in the conditioned space (i.e. an ICS installation), this heat is wasted.

Figure 4:
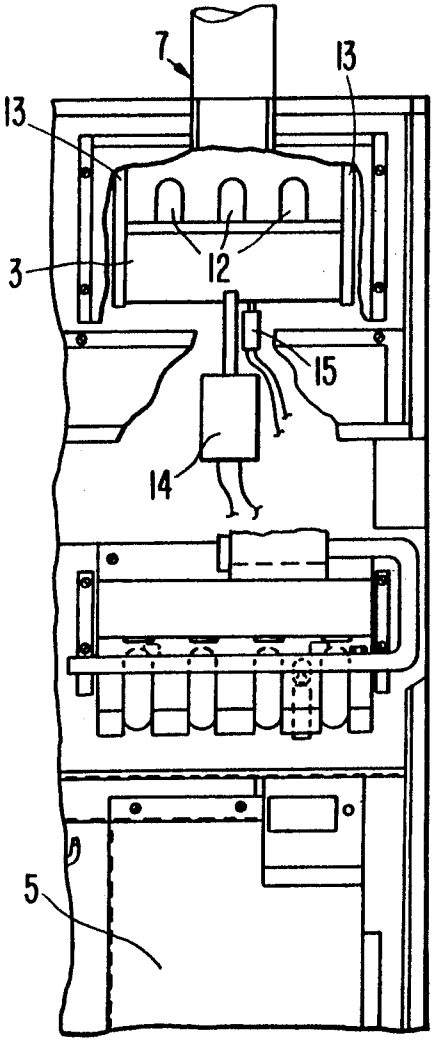
FIG. 4 is a front partial cross-sectional view of the furnace and flue closure system illustrated in FIG. 3.
Figure 3:
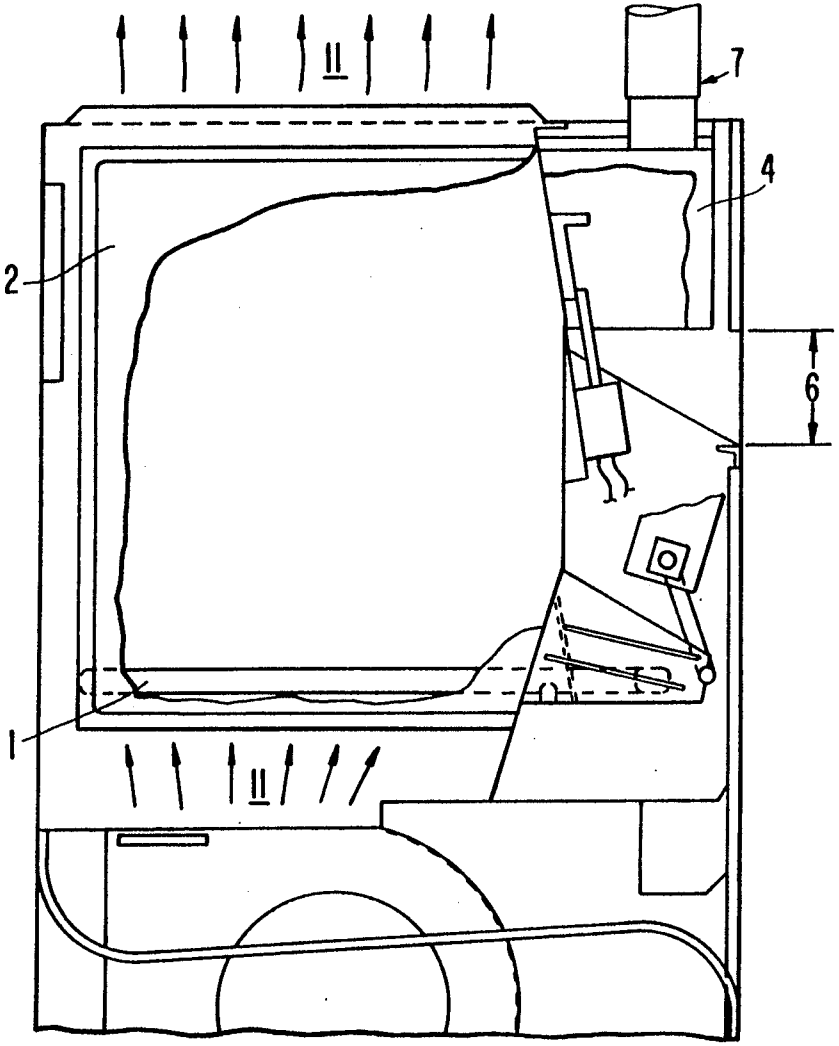
FIG. 3 is a side partial cross-sectional view of a furnace incorporating the flue system of the present invention.

FIGS. 3 and 4 depict a standard atmospherically vented gas-fired heat furnace and its components, including one embodiment of a flue closure system of the present invention. The illustrated flue closure system comprises a moveable plate 3 or similar enclosing means which is shaped in a manner capable of preventing flow of air through the heat exchanger. In the embodiment shown, moveable plate 3 is shaped in a manner capable of covering the heat exchanger outlets 12 so that air cannot flow through the heat exchanger outlets 12. The closure plate 3 is attached to the heat exchanger wall by tracks 13 which allow the plate 3 to move linearly along the wall of the heat exchanger 2. The tracks 13 are positioned so that the plate 3 can either be in a position to completely cover the heat exchanger outlets 12 (closed position) or be positioned so that it does not interfere with the flow of flue gases through the flue gas passages and outlets 12 of the heat exchanger (open position). The plate 3 is moved along the tracks 13 by an actuator 14. The actuator 14 shown in the figures is a linear motor directly connected to the plate 3 and attached to the outside wall of the heat exchanger. The linear motor is attached by wires to control circuitry which causes the motor to place the closure plate in an open position when the burner is operating and in a closed position when the burner is off. Alternatively, the actuator 14 can be a solenoid together with a linkage to multiply the displacement of the solenoid or other similar device capable of moving the plate 3 along the tracks 13. For example, a pneumatic or hydraulic cylinder and appropriate mechanical linkages can be used.

The flue closure device is integrated with the design and operation of the burner 1. The burner 1 operates in a cyclical manner: burning gas and producing combustion products during its on cycle and producing no combustion products during its off cycle. When the burner 1 is operating, the closure plate 3 remains in its fully open position so as not to interfere with the flow of flue gases through the heat exchanger 2. However, immediately after the burner-on cycle, the actuator 14 is energized and pushes the plate 3 to its fully closed position which tightly closes off the heat exchanger outlets 12, preventing air to flow through. Thus, air can no longer flow through the flue gas passages and wastefully cool the heat exchanger. The heat exchanger stays warm longer and therefore can later beneficially transfer heat to the circulating air, rather than waste the heat through an exhaust to the outdoors. The present invention, thus, traps residual heat in the furnace's heat exchanger at the end of a burner-on cycle and enables the transfer of residual heat to the air that circulates through the furnace to the conditioned space. The plate 3 remains in its fully closed position during the entirety of burner-off cycle. At the start of the next burner-on cycle, the actuator 14 is energized to move plate 3 back to its fully open position.

To ensure that the plate 3 is in its correct position, an electrical safety switch 15 is attached to the closure plate 3 and is used as an interlock to prevent burner operation unless the plate 3 is in its fully open position. The switch is part of the circuitry that turns the burner on. When the plate 3 moves to its fully open position, the normally open contacts in the switch 15 are closed, and burner operation occurs in a normal manner.

The present invention thus includes a closure member which in the open position permits the flow of flue gas through the heat exchanger and which in the closed position prevents the flow of air through the heat exchanger. The closure member is moved, held or biased to a closed position when the burner of the furnace is off, thereby preventing the loss of residual heat in the heat exchanger at the conclusion of an on cycle. When, or immediately before, the burners are turned on, the closure member is moved, biased, or held in an open position which permits the flow of flue gas through the heat exchanger and into the vent outlet of the furnace. The closure member can be biased, moved, or held in the open or closed position by a variety of different activators, such as motors, solenoids, pneumatic cylinders, hydraulic cylinders, linkages and springs. The system preferably includes a safety switch which prevents the burners from being turned on when the closure member is in the closed position. The system further includes a control system (such as electrical circuitry and conventional furnace controls) which is interconnected with the burner switch and the activator and which causes the closure member to be in the closed position when the burners are off and in the open position when the burners are on.

It will be apparent to those skilled in the art that various modifications and variations can be made in the flue closure system of the present invention and in construction of this system without departing from the scope or spirit of the invention. As an example a spring can be used to bias and hold the closure plate closed during the off cycle, and the motor, solenoid, or similar activator could be activated to open the device during the on cycle.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims, and equivalents thereof.

What is claimed is:

1. A flue closure system for a furnace which includes a burner and a heat exchanger through which flue gas flows, the system comprising:

a closure member which in an open position permits the flow of flue gas through the heat exchanger and in a closed position prevents the flow of air through the heat exchanger, the closure member including a closure plate which is slidably connected to the heat exchanger; and means for causing said closure member to be in the open position when the burners are on and to be in the closed position when the burners are off.

2. The flue closure system of claim 1 wherein said means for causing includes an actuator connected to said closure member.

3. The flue closure system of claim 2 wherein said causing means includes a mechanical linkage connected between the closure member and the actuator.

4. The flue closure system of claim 2 wherein said actuator includes a motor.

5. The flue closure system of claim 2 wherein said actuator includes a solenoid.

6. The flue closure system of claim 2 wherein said actuator is a pneumatic cylinder.

7. The flu closure system of claim 2 wherein said actuator includes a hydraulic cylinder.

8. The flue closure system of claim 1 wherein said causing means includes a spring for biasing said closure member to one of the open and closed positions (the biased position).

9. The flue closure system of claim 8 wherein said causing means further includes an actuator for moving said closure member from the biased position to the other of the open and closed positions.

10. The flue closure system of claim 1 wherein the heat exchanger includes exhaust outlets and said closure plate closes the exhaust outlets of the heat exchanger when the closure member is in the closed position.

11. The flue closure system of claim 2 wherein the closure member and the activator are integral parts of the furnace.

12. The flue closure system of claim 1 wherein the furnace includes a housing and the closure member is positioned within the housing of the furnace.

13. The flue closure system of claim 1 further comprising means for preventing burner operation when said closure member is in the closed position.

14. The flu closure system of claim 13 wherein said means for preventing burner operation includes a switch connected to said closure member.

15. The flu closure system of claim 14 wherein said causing means includes an actuator connected to said closure member and a control system interconnected with said actuator and said switch.

16. The flu closure system for a furnace which includes a burner and a heat exchanger, including a heat exchanger wall and flue gas outlets, through which flue gas flows, the system comprising:

a closure plate slidably attached to the heat exchanger wall and positioned so that said closure plate closes the flue gas outlets when the closure plate is in an closed position and opens the flue gas outlets when the closure plate is in an open position;

means for moving said closure plate to the closed position when the burner is off and moving said closure plate to the open position when the burner is on; and means for preventing burner operation until said closure plate is in the open position.

17. The flue closure system of claim 16 wherein the furnace includes a housing and the closure plate and moving means are contained within the housing.

* * * * *